United States Patent [19]

Chen

[11] Patent Number: 4,978,047

[45] Date of Patent: Dec. 18, 1990

[54] DEVICE FOR FACILITATING THE HAMMERING OF NAIL

[76] Inventor: Alex Chen, No. 48-1, Hsueh Tien Rd., Hsueh Tein Tsun, Wu Jih Hsiang, Taichung Hsien, Taiwan

[21] Appl. No.: 419,673

[22] Filed: Oct. 11, 1989

[51] Int. Cl.[5] ..... B25C 1/02

[52] U.S. Cl. ..... 227/147; 227/149

[58] Field of Search ..... 227/147, 149

[56] References Cited

U.S. PATENT DOCUMENTS

| | | | |
|---|---|---|---|
| 4,437,602 | 3/1984 | Kaczmarek | 227/147 |
| 4,461,418 | 7/1984 | Schaefer | 227/147 |
| 4,676,424 | 6/1987 | Meador et al. | 227/147 |

*Primary Examiner*—Paul A. Bell

*Attorney, Agent, or Firm*—Poms, Smith, Lande & Rose

[57] ABSTRACT

A device for facilitating the hammering of a nail including a substantially cylindrical outer casing having a first open end and a second open end. A striking pin having a first end with a rounded head provided thereon disposed to be struck by a hammer or the like. An inner tube is received in the outer casing and attached to the striking pin at a first end thereof. The inner tube is longitudinally slidable in the outer casing. Two flexible holding strips each having a concave portion are disposed to be pressed outwardly for receiving a nail to be hammered therebetween. A hammering pin is attached to a second end of the inner tube at a first end thereof. A second end of the hammering pin is disposed to abut the head of the nail to be hammered which is held by the concave portions of the two holding strips before hammering. Two springs are provided for repositioning the hammering pin, the inner tube and the striking pin after the hammering of the nail is completed.

1 Claim, 3 Drawing Sheets

DEVICE FOR FACILITATING THE HAMMERING OF NAIL

BACKGROUND OF THE INVENTION

The present invention relates to a device for facilitating the hammering of a nail.

Although the industry has been highly developed, hand tools still play an important role in daily life, for example, using a nail to connect two materials simply by striking the nail with a hammer. Nevertheless, the nail is very often bent by the striking of the hammer during hammering, especially when the person is nor a skilled carpenter. Even a skilled carpenter may still encounter problems when hammering during his work. The nail is almost inevitably bent in some cases at some time. Furthermore, it is very difficult to hammer a nail when the fixing position is located within a deep slot or the like. The nail is inevitably very hard to hold and it often is impossible to strike the nail with the hammer.

The present invention provides a device for facilitating the hammering of a nail such that hammering can be easily achieved under all kinds of working conditions.

SUMMARY OF THE INVENTION

It is an object of the present invention to provide a device for facilitating the hammering of a nail.

It is another object of the present invention to provide a device for facilitating the hammering of a nail, wherein the hammering of a nail in a slot or the like can also be easily achieved.

It is still another object of the present invention to provide a device for facilitating the hammering of a nail which can be easily used by an unskilled person.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENTS

Figure 1:
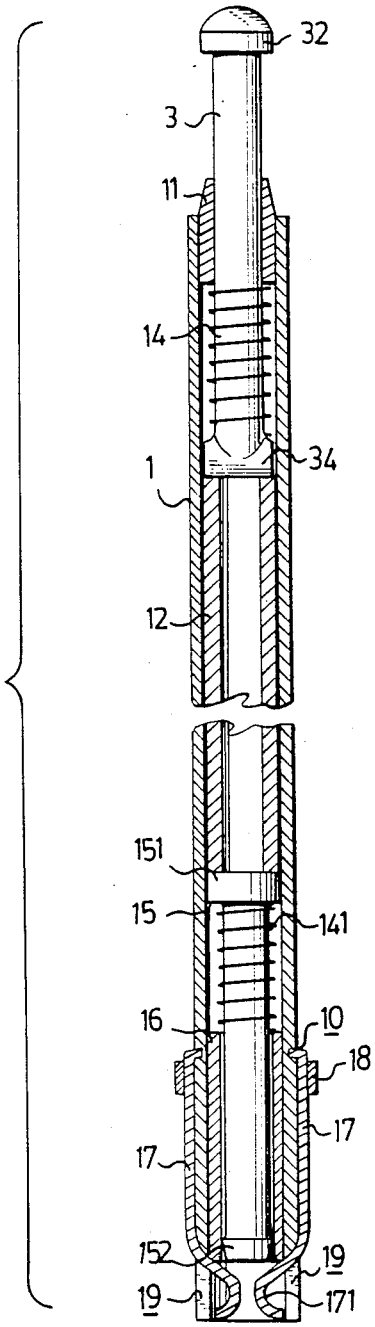
FIG. 1 is a cross-sectional view of a device for facilitating the hammering of a nail in accordance with the present invention.
Figure 2:
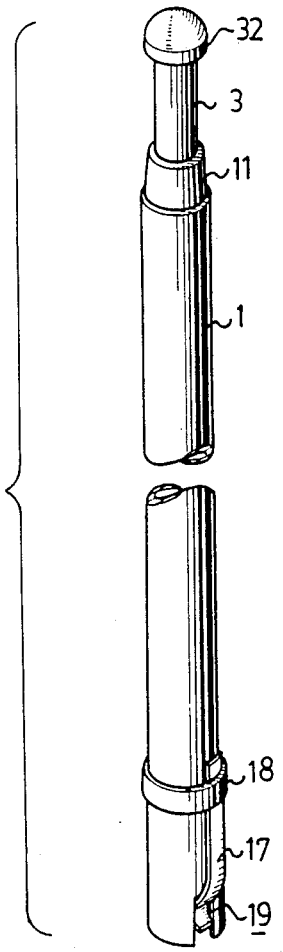
FIG. 2 is a perspective view of a device for facilitating the hammering of a nail in accordance with the present invention.
Figure 3:
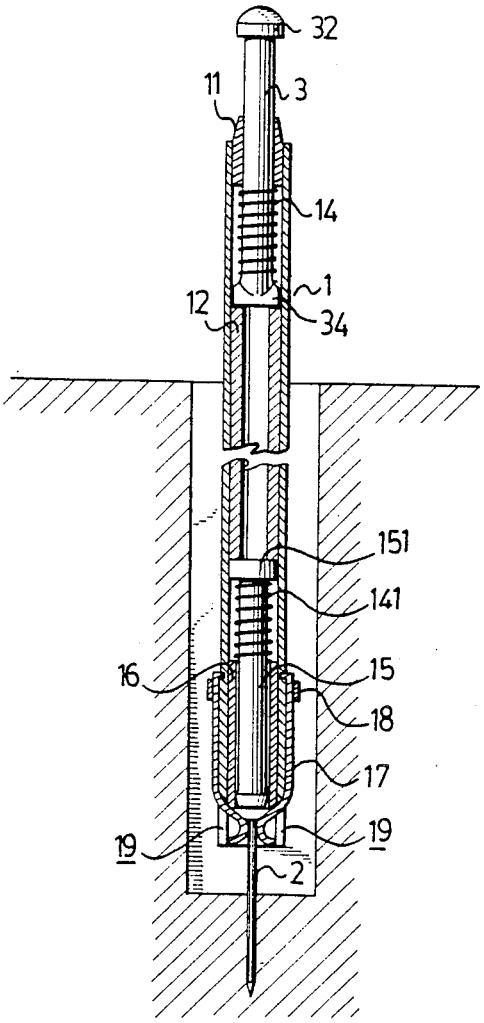
FIG. 3 is a cross-sectional view of a device for facilitating the hammering of a nail in accordance with the present invention showing a working state thereof.

Referring to FIGS. 1 to 3, a device for facilitating the hammering of a nail according to the present invention is shown. The device comprises a substantially cylindrical outer casing 1 having a first open end and a second open end. A lowermost portion of the outer casing 1 has two openings symmetrically provided on a periphery thereof adjacent to the second open end.

A striking pin 3 having a first end with a rounded head 32 provided thereon disposed to be struck by a hammer or the like. A first flat head 34 having an outer diameter the same as an inner diameter of the outer casing 1 is provided on a second end of the striking pin 3. An annular first hollow stop 11 is mounted on an inner wall of the first open end of the outer casing 3. The first hollow stop 11 has an outer diameter the same as the inner diameter of the outer casing 1 and an inner diameter the same as an outer diameter of the striking pin 3 for the striking pin 3 to pass therethrough. The striking pin 3 is longitudinally slidable in the first hollow stop 11.

The first hollow stop 11 has a first end protruding from the first open end of the outer casing 1 for the rounded head 32 of the striking pin 3 to stop thereon in response to a striking of a hammer on the rounded head 32. The first end of the striking pin 3 protrudes from the first end of the first hollow stop 11. The second end of the striking pin 3 is positioned within the outer casing 1. A first spring 14 is provided between a second end of the first hollow stop 11 and the first head 34 of the striking pin 3 for returning the striking pin 3 back to an original position after the hammering of a nail 2 is completed.

An inner tube 12 is received in said outer casing 1 and attached to the striking pin 3 at a first end thereof. The inner tube 12 has an outer diameter the same as the inside diameter of the outer casing 1 and is longitudinally slidable in the outer casing 1

Two flexible holding strips 17, each having a concave portion 171 formed at a first end thereof, are mounted on an outer periphery of a lower portion of the outer casing 1 at a second end thereof by a fastening ring 18 provided on the outer periphery of the outer casing 1 such that each concave portion 171 is positioned within the outer casing 1 via the corresponding two openings 19 of the outer casing 1. Two recesses 10 are provided on the outer periphery of the outer casing 1 and are mated with a flanged end of each flexible holding strip 17 to enhance the fixing of the flexible holding strips 17. The concave portions 171 of the flexible holding strips 17 are disposed to be pressed outwardly when receiving a nail 2 to be hammered therebetween. The concave portions 171 of the two flexible strips 17 hold the head of the nail 2 and move outwardly to release the nail 2 in response to a strike on the rounded head 32 of the striking pin 3.

An annular second hollow stop 16 is mounted on an inner wall of the lower portion of the outer casing 1. A hammering pin 15 passes through the annular second hollow stop 15 and is longitudinally slidable in the second hollow stop 16. The hammering pin 15 has a second flat head 151 formed ar a first and thereof and is attached to a second end of the inner tube 12. A second end 152 of the hammering pin 15 is disposed to abut the head of the nail 2 to be hammered which is held by the concave portions 171 of the two holding strips 17 before hammering. A second spring 141 is provided between the second flat head 151 of the hammering pin 15 and the second hollow stop 16 for repositioning the hammering pin 15, the inner tube 12 and the striking pin 3 to their original positions after the hammering of the nail 2 is completed.

In the operation of the device, the concave portions 171 of the two flexible holding strips 17 are first pressed outwardly by a head of a nail 2 as it is inserted. After the nail 2 is inserted, the two concave portions 171 come together and hold the nail in place. The device, together with the nail 2, is placed at the position to be nailed. Then, the rounded head 32 of the striking pin 3 is struck by a hammer or the like. The striking pin 3, the inner tube 12 and the hammering pin 15 move downwardly in response to the strike. The concave portions 171 of the flexible holding strips 17 are pushed outwardly and let the nail 2 move downwardly and enter the material to be nailed. The downstroke of the second flat head 151 of the hammering pin 15 compressed the second spring 141 and is then stopped by the second hollow stop 16. After the nail 2 is ejected from the device, the first spring 14 and the second spring 141 cause the striking pin 3, the inner tube 12 and the hammering pin 16 to move upward and these three elements are returned to their original positions.

As can be seen in the drawings and the descriptions set forth in the specification, the Present invention provides assistance in the hammering of a nail for a carpenter, especially in a slot or the like, where it is hard to work thereat.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A device for facilitating the hammering of a nail comprising:

a substantially cylindrical outer casing having a first open end and a second open end, a lowermost portion of said outer casing having two openings symmetrically provided on a periphery thereof adjacent to said second open end;

a striking pin having a first end with a rounded head provided thereon disposed to be struck by a hammer, a first flat head having an outer diameter the same as an inner diameter of said outer casing being provided on a second end of said striking pin, an annular first hollow stop being mounted on an inner wall of said first open end of said outer casing, said first hollow stop having an outer diameter the same as said inner diameter of said outer casing and an inner diameter the same as an outer diameter of said striking pin for said striking pin to pass therethrough, said first hollow stop having a first end protruding from said first open end of said outer casing for said rounded head of said striking pin to stop thereon in response to a strike of said hammer on said rounded head, said striking pin being longitudinally slidable in said first hollow stop, said first end of said striking pin protruding from said first end of said first hollow stop, said second end of said striking pin being positioned within said outer casing, a first spring being provided between a second end of said first hollow stop and said first flat head of said striking pin for returning said striking pin back to an original position after the hammering of a nail is completed;

an inner tube being received in said outer casing and attached to said striking pin at a first end thereof, said inner tube having an outer diameter the same as said inside diameter of said outer casing and being longitudinally slidable in said outer casing;

two flexible holding strips each having a concave portion formed at a first end thereof, said two flexible holding strips being mounted on an outer periphery of a lower portion of said outer casing at a second end thereof such that each concave portion is positioned within said outer casing via corresponding said two openings of said outer casing, said concave portions of said flexible holding strips being disposed to be pushed outwardly by a head of a nail to be hammered therebetween, said concave portions of said two flexible holding strips holding the head of said nail and moving outwardly for releasing said nail in response to a strike on said rounded head of said striking pin;

an annular second hollow stop being mounted on an inner wall of said lower portion of said outer casing; and a hammering pin passing through said annular second hollow stop and being longitudinally slidable in said second hollow stop, said hammering pin having a second flat head formed at a first end thereof and being attached to a second end of said inner tube, a second end of said hammering pin being disposed to abut the head of said nail to be hammered which is held by said concave portions of said two flexible holding strips before hammering, a second spring being provided between said second flat head of said hammering pin and said second hollow stop for repositioning said hammering pin, said inner tube and said striking pin after the hammering of said nail is completed.

* * * * *